US007736216B2

(12) United States Patent
King et al.

(10) Patent No.: US 7,736,216 B2
(45) Date of Patent: Jun. 15, 2010

(54) SANDER HAVING REMOVABLE PLATEN

(75) Inventors: Wade C. King, Finksburg, MD (US); Andrew Walker, Newton Hall (GB); Earl E. Kelican, Jr., New Oxford, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/195,234

(22) Filed: Aug. 20, 2008

(65) Prior Publication Data

US 2010/0048109 A1 Feb. 25, 2010

(51) Int. Cl.
*B24B 23/00* (2006.01)

(52) U.S. Cl. ..... 451/357; 451/456

(58) Field of Classification Search ..... 451/456, 451/354, 356, 357, 490, 508, 509, 539, 358, 451/359
See application file for complete search history.

(56) References Cited

U.S. PATENT DOCUMENTS

| | | | | |
|---|---|---|---|---|
| 1,965,669 | A | 7/1934 | Robb | |
| 2,370,323 | A * | 2/1945 | Patt | 451/490 |
| 2,898,616 | A | 8/1959 | Coover | |
| 3,566,895 | A | 3/1971 | Goto et al. | |
| 3,724,237 | A | 4/1973 | Wood | |
| 3,759,336 | A | 9/1973 | Marcovitz et al. | |
| 3,761,663 | A | 9/1973 | Brown | |
| 3,793,776 | A | 2/1974 | Sadow, Jr. et al. | |
| 3,899,852 | A | 8/1975 | Batson | |
| 3,908,139 | A | 9/1975 | Duncan, Jr. | |
| 4,103,511 | A | 8/1978 | Kress et al. | |
| 4,125,339 | A | 11/1978 | Pittinger, Sr. et al. | |
| 4,251,120 | A | 2/1981 | Wolff | |
| RE30,680 | E | 7/1981 | Kress et al. | |
| 4,871,629 | A | 10/1989 | Bunyea | |
| 5,157,873 | A | 10/1992 | Rudolf et al. | |
| 5,386,667 | A | 2/1995 | Hausslein et al. | |
| 5,421,053 | A | 6/1995 | Chodak | |
| 5,496,207 | A | 3/1996 | Hornung et al. | |
| 5,679,066 | A | 10/1997 | Butz et al. | |
| 5,709,595 | A | 1/1998 | Bergner et al. | |
| 5,879,227 | A * | 3/1999 | Martin et al. | 451/356 |
| 5,885,146 | A | 3/1999 | Cockburn | |

(Continued)

FOREIGN PATENT DOCUMENTS

| | | |
|---|---|---|
| BE | 643674 | 5/1964 |

(Continued)

*Primary Examiner*—Robert Rose
(74) *Attorney, Agent, or Firm*—Harness, Dickey & Pierce, P.L.C.

(57) ABSTRACT

A tool for moving an abrasive media. The tool includes a tool body, a platen, a drive system and a retaining knob. The platen has an exterior platen surface and a knob aperture that is formed through the exterior platen surface. The drive system is housed in the tool body and configured to move the platen. The drive system includes an output member with a first threaded portion. The retaining knob is received through the knob aperture in the exterior platen surface of the platen. The retaining knob has a knob portion, which has an exterior surface, and an attachment member with a second threaded portion that is threadably coupled to the first threaded portion. The platen surface and at least a portion of the knob surface are co-planar. A related method is also provided.

13 Claims, 5 Drawing Sheets

U.S. PATENT DOCUMENTS

| | | | |
|---|---|---|---|
| 5,941,891 | A | 8/1999 | Walen |
| 6,004,194 | A | 12/1999 | Hild et al. |
| 6,159,084 | A | 12/2000 | Tiede |
| 6,170,579 | B1 | 1/2001 | Wadge |
| 6,176,322 | B1 | 1/2001 | Wadge |
| 6,206,107 | B1 | 3/2001 | Wadge |
| 6,244,933 | B1 | 6/2001 | Morkvenas |
| 6,286,611 | B1 | 9/2001 | Bone |
| 6,553,642 | B2 | 4/2003 | Driessen |
| 6,634,439 | B2 | 10/2003 | Driessen |
| 6,675,911 | B2 | 1/2004 | Driessen |
| 6,780,094 | B2 | 8/2004 | Walker |
| 6,875,095 | B2 | 4/2005 | Walker |
| 7,235,005 | B2 | 6/2007 | Schnell et al. |
| 7,270,591 | B2 | 9/2007 | Deshpande et al. |
| D573,857 | S | 7/2008 | Stratford |
| 7,476,144 | B2 | 2/2009 | Dineen |
| 7,485,026 | B2 | 2/2009 | King |
| 2006/0019585 | A1 | 1/2006 | Zayat et al. |

FOREIGN PATENT DOCUMENTS

| | | |
|---|---|---|
| EP | 0 694 365 | 7/1995 |
| EP | 0 842 012 | 1/1997 |
| EP | 0 906 812 | 8/1998 |

* cited by examiner

SANDER HAVING REMOVABLE PLATEN

The present invention generally relates to a sander with a removable platen.

Sanders typically have a platen to which an abrasive media, such as sandpaper, is attached. Sanders with removable, differently shaped platens (e.g., rectangular, square, round) are available to permit the user of the sander to change the platen to one with a shape that is best suited for a given sanding task. Such removable platens typically require one or more threaded fasteners (e.g., socket head cap screws) requiring the use of tools (e.g., alien wrenches) to remove the threaded fasteners from the sander to thereby decouple the platen from the sander.

Various tool-less coupling systems have been developed for coupling a platen to the rotating output member of a rotary grinder. Such coupling systems, however are relatively large and costly and do not support an abrasive media in an area where one element of the coupling system is received against the platen.

SUMMARY

This section provides a general summary of some aspects of the present disclosure and is not a comprehensive listing or detailing of either the full scope of the disclosure or all of the features described therein.

In one form, the present teachings provide a tool for moving an abrasive media. The tool includes a tool body, a platen, a drive system and a retaining knob. The platen has an exterior platen surface and a knob aperture that is formed through the exterior platen surface. The drive system is housed in the tool body and configured to move the platen. The drive system includes an output member with a first threaded portion. The retaining knob is received through the knob aperture in the exterior platen surface of the platen. The retaining knob has a knob portion, which has an exterior surface, and an attachment member with a second threaded portion that is threadably coupled to the first threaded portion. The platen surface and at least a portion of the knob surface are co-planar.

In another form, the present teachings provide a method that includes: providing a tool with a tool body and a drive system, the drive system having an output member; mounting a platen to the output member; installing a retaining knob into a knob aperture in the platen; and tightening the retaining knob to the output member such that an exterior surface of the platen is co-planar with at least a portion of the retaining knob.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

The drawings described herein are for illustrative purposes only and are not intended to limit the scope of the present disclosure in any way. The drawings are illustrative of selected teachings of the present disclosure and do not illustrate all possible implementations. Similar or identical elements are given consistent identifying numerals throughout the various figures.

DETAILED DESCRIPTION OF THE VARIOUS EMBODIMENTS

Figure 1:
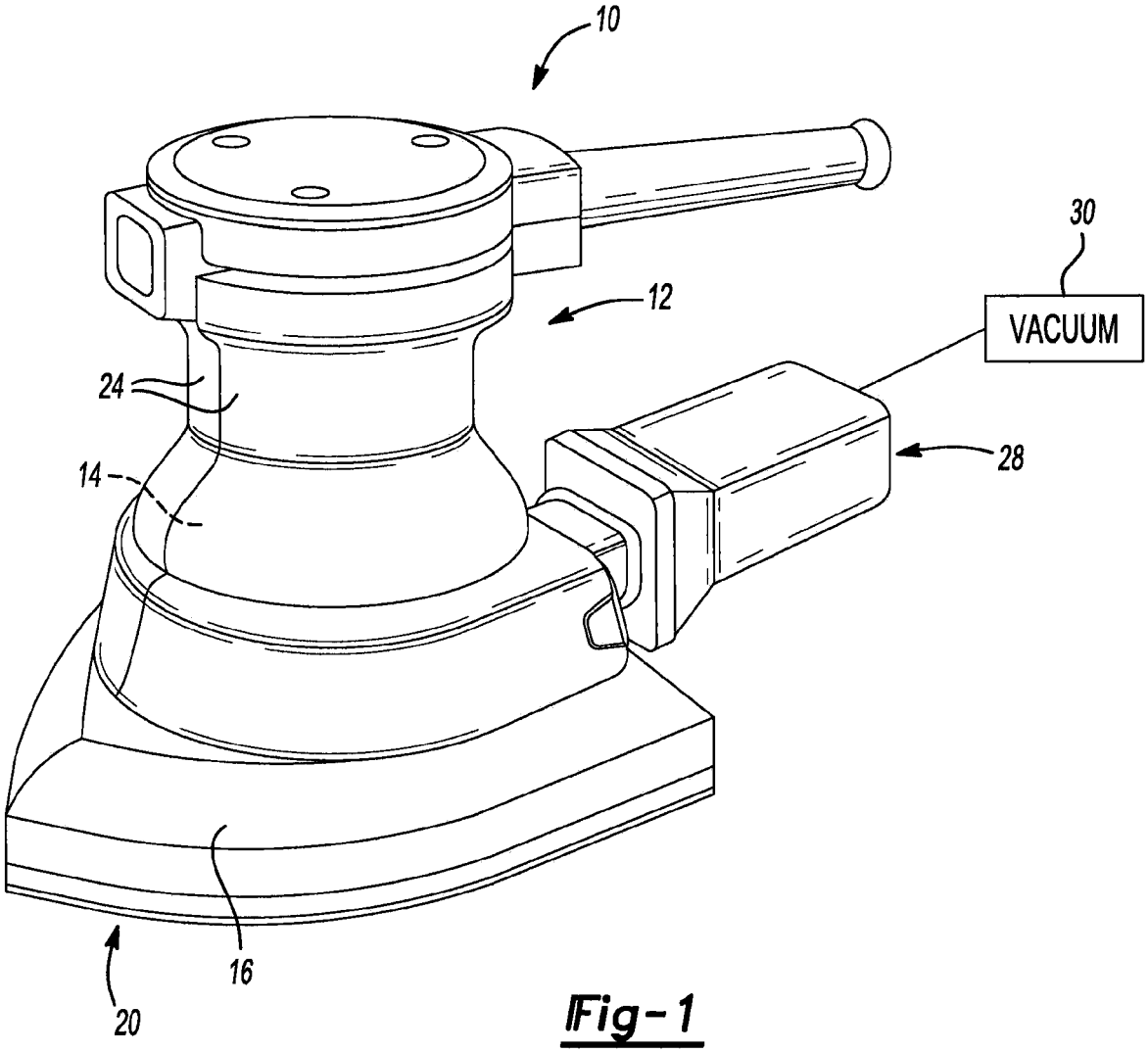
FIG. 1 is a perspective view of an exemplary abrasive material removal tool constructed in accordance with the teachings of the present disclosure.
Figure 2:
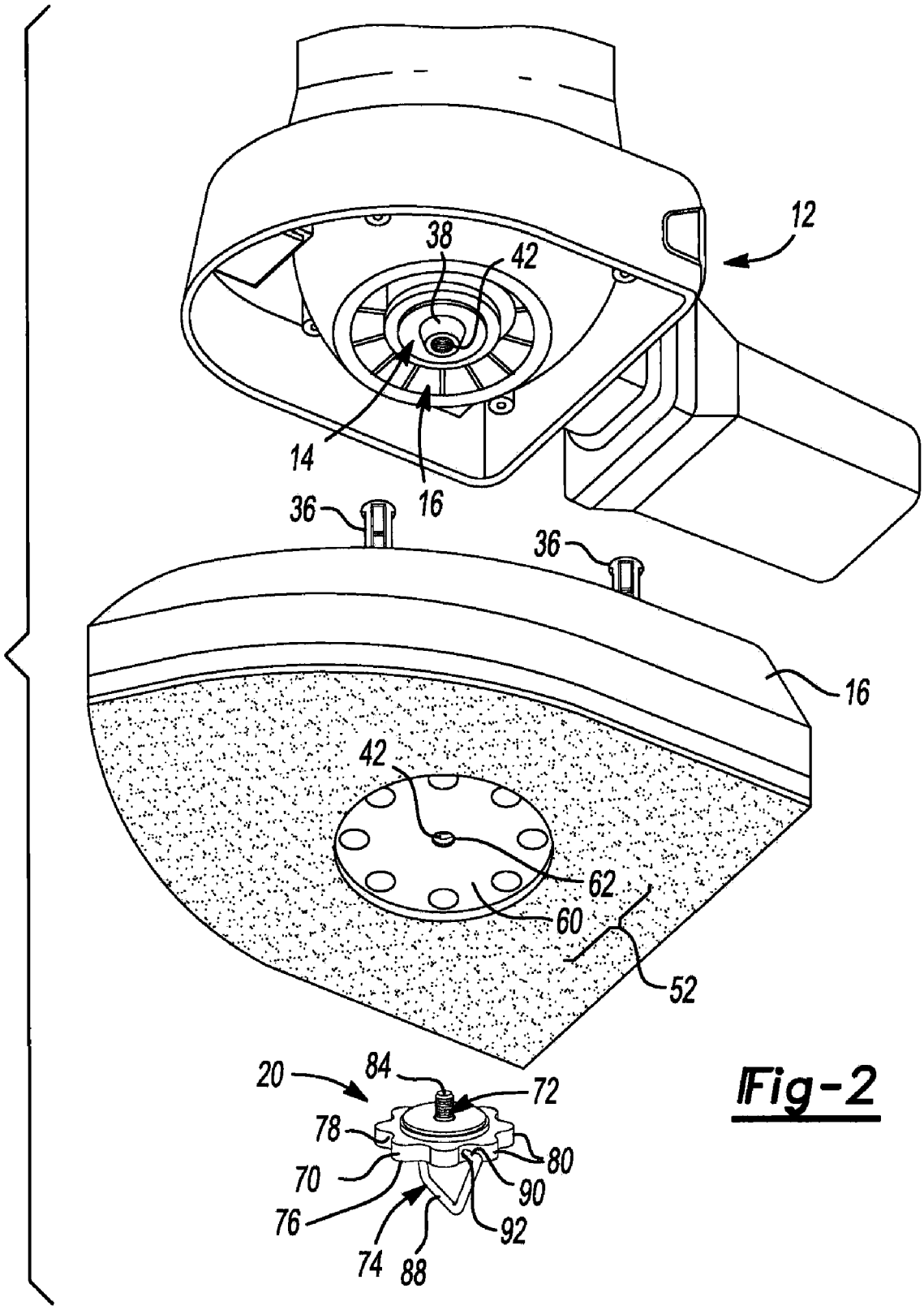
FIG. 2 is an exploded perspective view of a portion of the abrasive material removal tool of FIG. 1.
Figure 3:
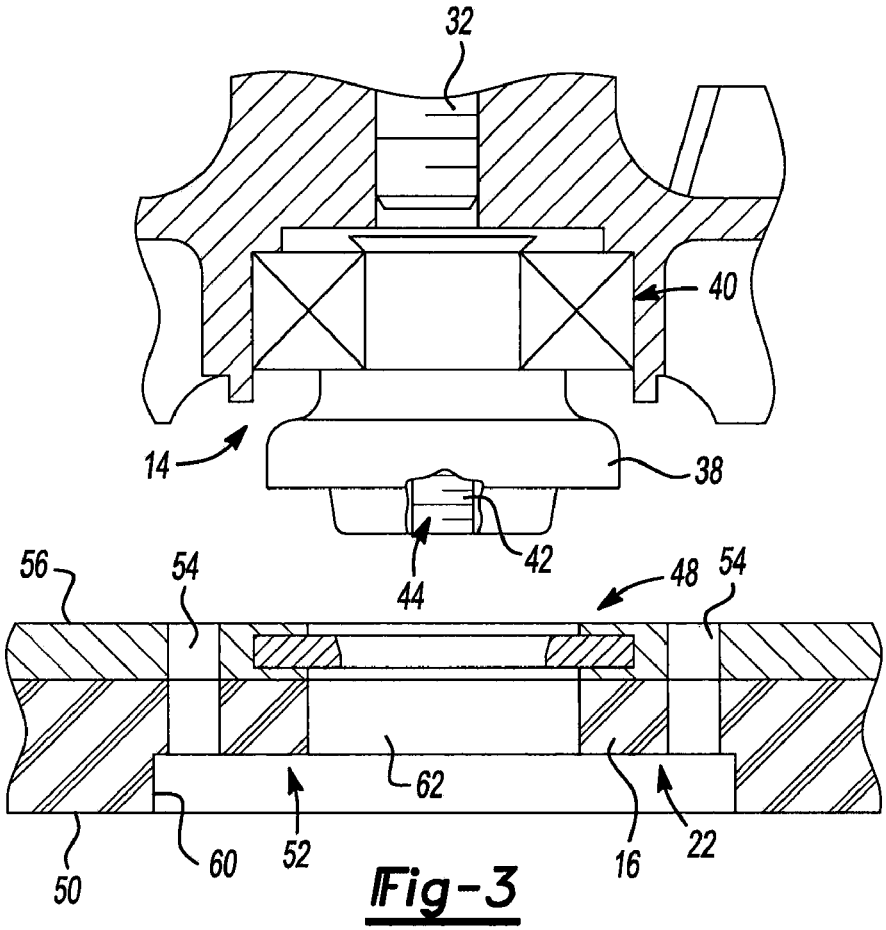
FIG. 3 is an exploded section view of a portion of the abrasive material removal tool of FIG. 1, illustrating the output member and the platen in more detail.

With reference to FIGS. 1 through 3 of the drawings, an abrasive material removal tool is generally indicated by reference numeral 10. The tool 10 can include a housing or tool body 12, a drive system 14, a platen 16 and a retaining knob 20. The tool body 12 and the drive system 14 can be conventional in their construction and operation and as such, need not be discussed in significant detail herein. Briefly, the tool body 12 can include a pair of housing shells 24 that cooperate to define a cavity (not specifically shown), which can house the drive system 14, and a dust extraction port 28 to which a vacuum 30 can be coupled to extract dust and debris generated during operation of the tool 10. The drive system 14 can include a motor 32, such as an electric or pneumatic motor, and a transmission 34 that can include a resilient mount 36 and an output member 38. The transmission 34 can receive a rotary output from the motor 32 and transmit power to the output member 38 at a predetermined speed ratio and/or predetermined direction. In this regard, the transmission 34 can include a mechanism 40 for generating movement of the output member 38 in a desired manner. U.S. Pat. Nos. 6,132,300 and 5,885,146 provide examples of abrading tools that provide orbital and random orbit motion, while U.S. Pat. No. 3,371,451 provides an example of an abrading tool that provides reciprocating and orbital motion. These patents are hereby incorporated by reference as if fully set forth in detail herein. In the particular example provided, the transmission 34 is configured to provide orbital movement.

The platen 16 is configured to be driven by the output member 38 of the transmission 34 and can include a cup 48, an exterior platen surface 50, a knob aperture 52 and a plurality of dust extraction holes 54. The cup 48 can be formed into a surface 56 opposite the exterior platen surface 50 and can be configured to receive the output member 38 of the transmission 34. The exterior platen surface 50 can be configured to a desired shape and in the example provided, is generally flat. The knob aperture 52 can include a counterbore 60 and a through-hole 62 that can be disposed generally concentric with the counterbore 60. The dust extraction holes 54 can be formed through the platen 16 at any desired location and can be disposed in any desired pattern. In the particular example provided, we employed eight evenly spaced-apart dust extraction holes 54 that were located in the counterbore 60 concentrically about the through-hole 62. The dust extraction holes 54 can be in fluid communication with the dust extraction port 28 in the tool body 12.

Figure 4:
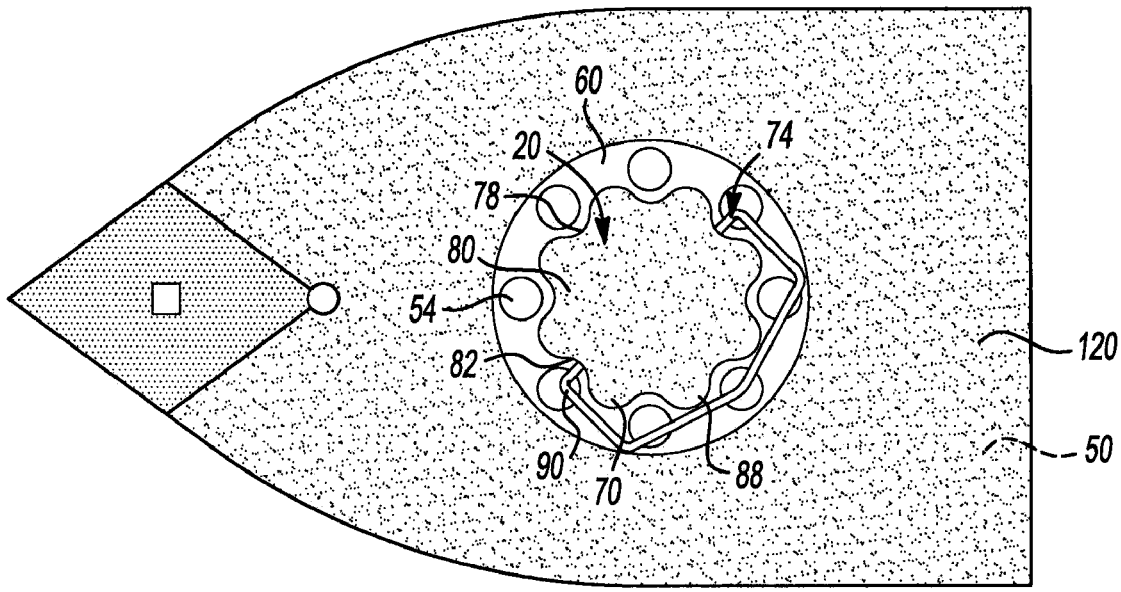
FIG. 4 is a perspective view of the bottom of the abrasive material removal tool of FIG. 1.
Figure 5:
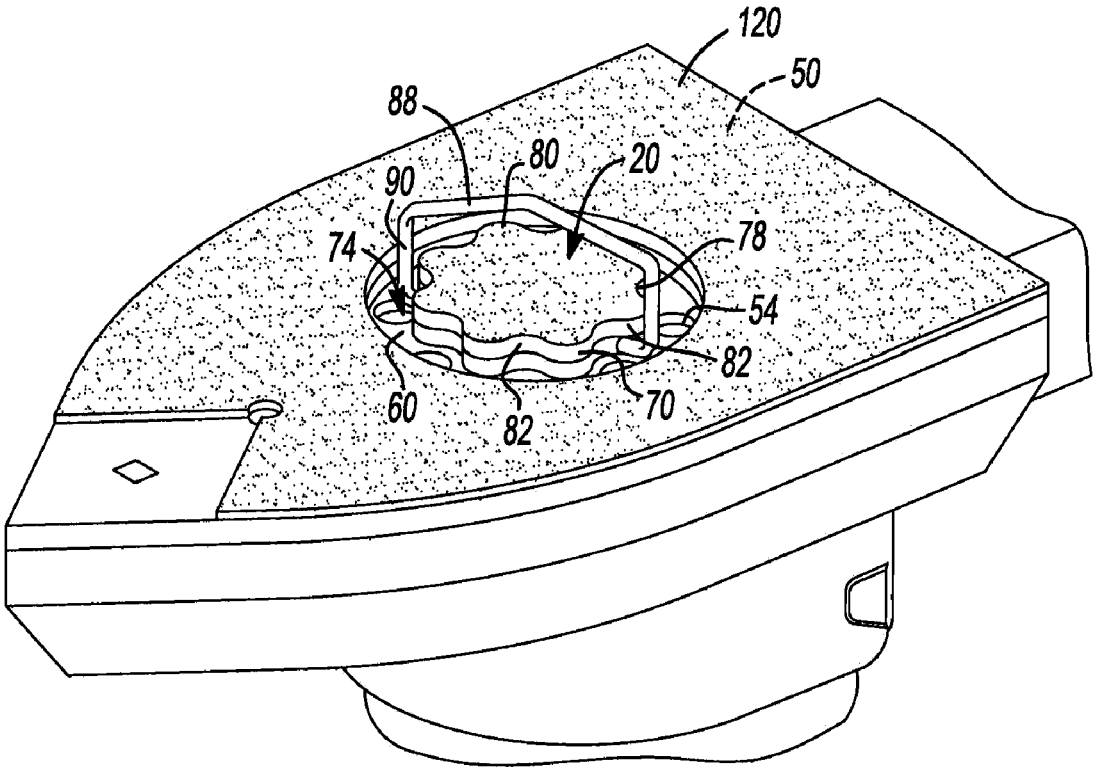
FIG. 5 is a perspective view of a bottom portion of the abrasive material removal tool of FIG. 1 illustrating the handle of the retaining knob in a raised position.

With reference to FIGS. 2 and 4, the retaining knob 20 can include a knob portion 70, an attachment member 72 and a handle 74. The knob portion 70 can include an exterior knob surface 76 and a manual gripping surface 78 that can be configured to be gripped by the hand of an operator to install or remove the retaining knob 20. In the example provided, a plurality of teeth 80 and valleys 82, which are interposed between adjacent teeth 80, are formed into the manual gripping surface 78. Any quantity of teeth 80 can be employed but in the example provided, the quantity of teeth 80 is equal to the quantity of the dust extraction holes 54 (i.e., eight). The attachment member 72 can include a second threaded portion 84 that can be threadably coupled to the first threaded portion 42. In the example provided, the second threaded portion 84 includes a male threaded stud that can threadably engage the female threads 44 in the first threaded portion 42. The handle 74 can be formed of an appropriate material, such as a steel wire. The handle 74 can be clip-like in its configuration and can include a generally U-shaped body 88 and a pair of inwardly extending tabs 90 that can extend into tab apertures 92 formed in the manual gripping surface 78 of the knob portion 70 generally perpendicular to a longitudinal axis of the attachment member 72. The handle 74 can be pivotally movable between a first position (FIG. 4), in which the U-shaped body 88 is generally parallel to the exterior knob surface 76, and a second position (FIG. 5) in which the U-shaped body 88 is generally perpendicular to the exterior knob surface 76.

The retaining knob 20 can be installed to the drive system 14 and the platen 16 such that the knob portion 70 is received in the knob aperture 52 and the attachment member 72 is received through the through-hole 62 and fixedly coupled to the output member 38 so that the knob portion 70 of the retaining knob 20 applies a compressive force to the platen 16 to secure the platen 16 to the output member 38. Accordingly, movement of the platen 16 can be effected via the drive system 14 through operation of the electric motor 32. The retaining knob 20 can be positioned such that the valleys 82 are aligned to the dust extraction holes 54. In this regard, the teeth 80 can be positioned such that they are not disposed in-line with the dust extraction holes 54.

Figure 6:
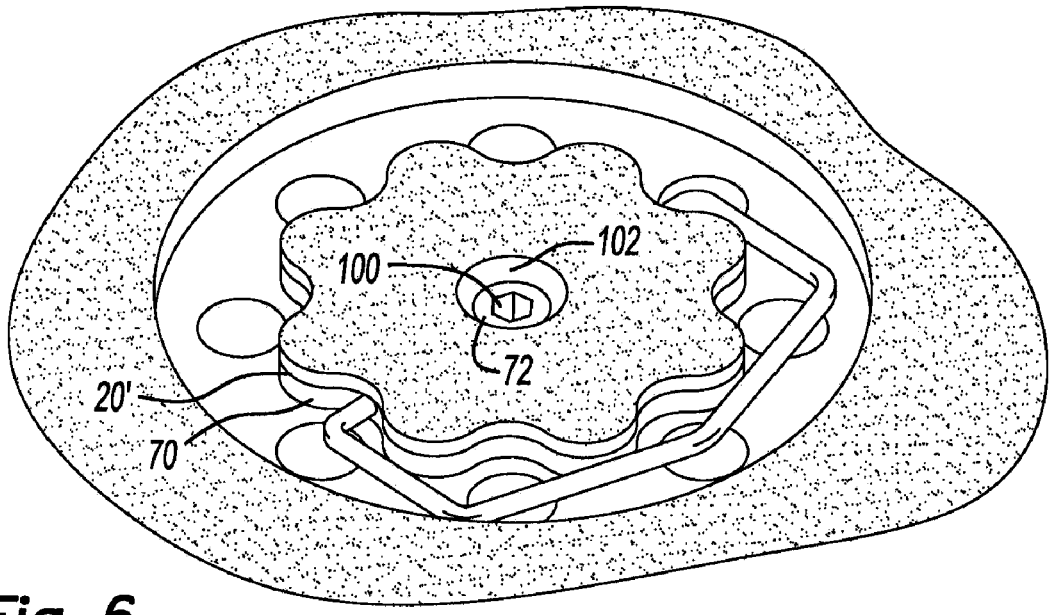
FIGS. 6 and 7 are perspective views of an alternative retaining knob that is suited for use with an Allen wrench.
Figure 7:
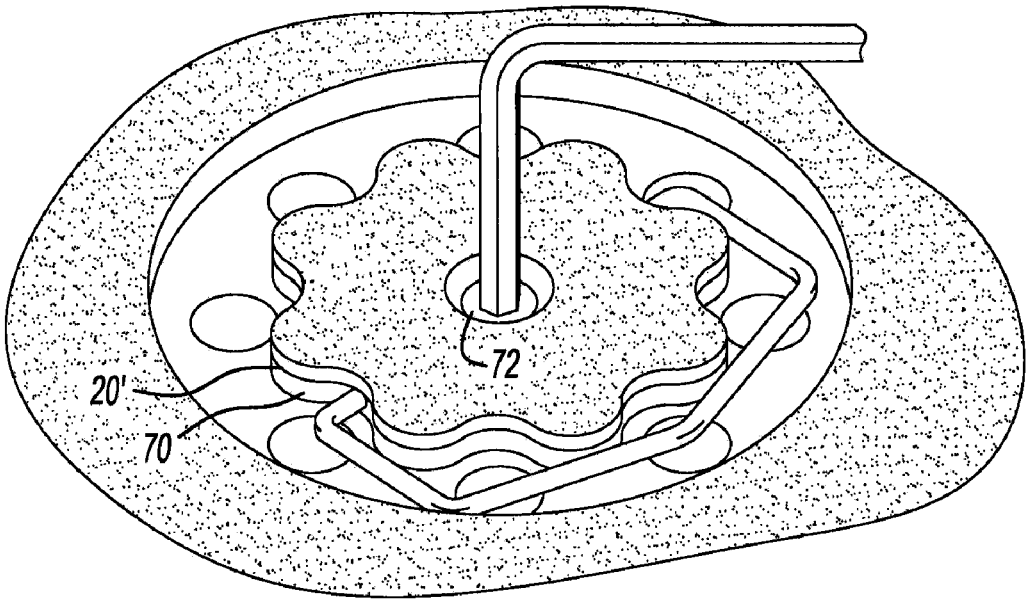

With brief reference to FIGS. 6 and 7, an alternately constructed retaining knob 20' is illustrated. The retaining knob 20' can be generally similar to the retaining knob 20 (FIG. 2) except that the attachment member 72 can extend through the knob portion 70 and could include a feature 100, such as a hexagonal hole, that facilitates the coupling of a tool to the attachment member 72 for installation and/or removal of the retaining knob 20 to the output member 38. In the example provided, a counterbored aperture 102 is formed into the knob portion 70 and the attachment member 72 is a socket-head cap screw that is configured to be received in the counterbored aperture 102 and threadably coupled to the output member 38.

Figure 8:
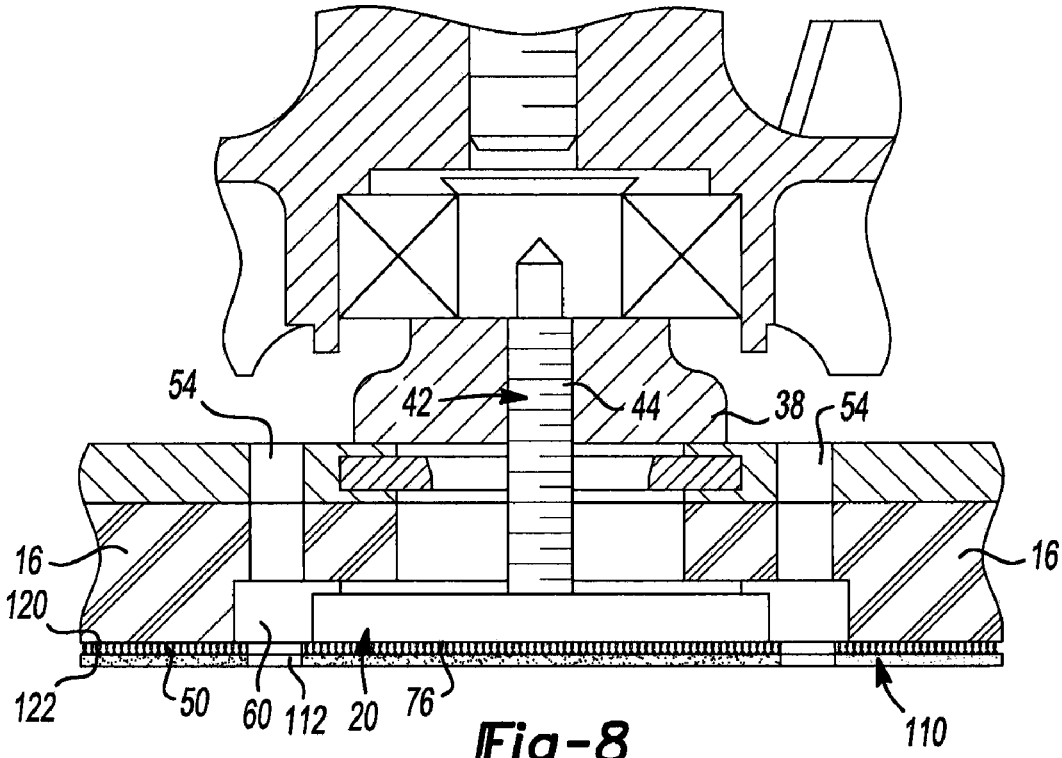
FIG. 8 is a longitudinal section view of a portion of the abrasive material removal tool of FIG. 1 illustrating the platen, the retaining knob and an abrasive material that is attached to the platen and the retaining knob.

With specific reference to FIGS. 4 and 8, an abrasive media, such as sandpaper 110 can be coupled to the platen 16. A plurality of dust extraction apertures 112 can be formed through the sandpaper 110 and correspond in quantity, shape and/or size to the dust extraction holes 54 in the platen 16. The exterior platen surface 50 and at least a portion of the exterior knob surface 76 can be co-planar so that the sandpaper 110 is supported over at least a portion of the area of the counterbore 60. Although the exterior platen surface 50 and the exterior knob surface 76 are illustrated in the example provided as being disposed in a generally flat plane, it will be appreciated that such plane could be contoured, bent or twisted. In this regard, the exterior knob surface 76 will conform to the plane that is defined by the exterior platen surface 50.

If desired, at least one of a hook fastener and a loop fastener of a hook-and-loop fastener system (e.g., VELCRO®) can be applied to the exterior platen surface 50 and the at least the portion of the exterior knob surface 76. In the particular example provided, a hook fastener 120 of a hook-and-loop fastener system is applied to the exterior platen surface 50 and the at least the portion of the exterior knob surface 76, while a loop fastener 122 of the hook-and-loop fastener system is applied to a corresponding (rear) surface of the sandpaper 110. Engagement of the loop fastener 122 to the hook fastener 120 can fixedly but removably couple the sandpaper 110 to both the platen 16 and the retaining knob 20. Advantageously, connection of the sandpaper 110 to the platen 16 and the retaining knob 20 inhibits the retaining knob 20 from rotating relative to the platen 16 so as to render the connection between the platen 16 and the drive system 14 more resistant to loosening due to vibration.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A tool for moving an abrasive media, the tool comprising:

a tool body;

a platen having an exterior platen surface and a knob aperture that is formed through the exterior platen surface;

a drive system housed in the tool body and configured to move the platen, the drive system including an output member with a first threaded portion; and a retaining knob that is received through the knob aperture in the exterior platen surface of the platen, the retaining knob having a knob portion and an attachment member, the knob portion having an exterior knob surface, the attachment member having a second threaded portion that is threadably coupled to the first threaded portion;

wherein the platen surface and at least a portion of the knob surface are co-planar, and wherein at least one of a hook fastener and a loop fastener of a hook-and-loop fastener system is applied to the platen surface and the at least the portion of the knob surface.

2. A tool for moving an abrasive media, the tool comprising:

a tool body;

a platen having an exterior platen surface and a knob aperture that is formed through the exterior platen surface;

a drive system housed in the tool body and configured to move the platen, the drive system including an output member with a first threaded portion; and a retaining knob that is received through the knob aperture in the exterior platen surface of the platen, the retaining knob having a knob portion and an attachment member, the knob portion having an exterior knob surface, the attachment member having a second threaded portion that is threadably coupled to the first threaded portion;

wherein the platen surface and at least a portion of the knob surface are co-planar, wherein a plurality of dust extraction holes are formed through the platen, and wherein the knob aperture includes a counterbore and a through-hole, wherein at least one of the first threaded portion and the second threaded portion is received through the through-hole and wherein the dust extraction holes are formed in the counterbore.

3. The tool of claim 2, wherein the dust extraction holes are disposed concentrically about the through-hole.

4. The tool of claim 2, wherein the knob portion includes exterior manual gripping surface.

5. A tool for moving an abrasive media, the tool comprising:

a tool body;

a platen having an exterior platen surface and a knob aperture that is formed through the exterior platen surface;

a drive system housed in the tool body and configured to move the platen, the drive system including an output member with a first threaded portion; and a retaining knob that is received through the knob aperture in the exterior platen surface of the platen, the retaining knob having a knob portion and an attachment member, the knob portion having an exterior knob surface, the attachment member having a second threaded portion that is threadably coupled to the first threaded portion;

wherein the platen surface and at least a portion of the knob surface are co-planar, and wherein the retaining knob further includes a handle that is movably coupled to the knob portion.

6. The tool of claim 5, wherein the knob aperture includes a counterbore and a through-hole, wherein at least one of the first threaded portion and the second threaded portion is received through the through-hole and wherein the handle is movable into a position where it is stored in the counterbore.

7. The tool of claim 5, wherein the handle comprises a wire clip that is pivotally coupled to the knob portion.

8. The tool of claim 1, wherein the exterior surface of the platen is disposed in a flat plane.

9. A method comprising:

providing a tool with a tool body and a drive system, the drive system having an output member;

mounting a platen to the output member;

installing a retaining knob into a knob aperture in the platen; and tightening the retaining knob to the output member such that an exterior surface of the platen is co-planar with at least a portion of the retaining knob;

coupling an abrasive media to the exterior surface of the platen, wherein the abrasive media is coupled to the platen via a hook-and-loop fastener system, and wherein at least one of a hook fastener and a loop fastener is disposed on the exterior surface of the retaining knob.

10. A method comprising:

providing a tool with a tool body and a drive system, the drive system having an output member;

mounting a platen to the output member;

installing a retaining knob into a knob aperture in the platen; and tightening the retaining knob to the output member such that an exterior surface of the platen is co-planar with at least a portion of the retaining knob, wherein the abrasive media non-rotatably couples the retaining knob to the platen.

11. A tool for moving an abrasive media, the tool comprising:

a tool body;

a platen having an exterior platen surface and a knob aperture that is formed through the exterior platen surface;

a drive system housed in the tool body and configured to move the platen, the drive system including an output member with a first threaded portion; and a retaining knob that is received through the knob aperture in the exterior platen surface of the platen, the retaining knob having a knob portion and an attachment member, the knob portion having an exterior knob surface, the attachment member having a second threaded portion that is threadably coupled to the first threaded portion;

wherein the platen surface and at least a portion of the knob surface are co-planar;

wherein at least one of a hook fastener and a loop fastener of a hook-and-loop fastener system is applied to the platen surface and the at least the portion of the knob surface;

wherein the platen includes a plurality of dust extraction holes that are formed through the platen;

wherein the knob aperture includes a counterbore and a through-hole, wherein at least one of the first threaded portion and the second threaded portion is received through the through-hole and wherein the dust extraction holes are formed in the counterbore;

wherein the dust extraction holes are disposed concentrically about the through-hole;

wherein the knob portion includes a toothed exterior manual gripping surface that defines a plurality of teeth and a plurality of valleys, each of the valleys being disposed between two of the teeth, and wherein the valleys are aligned to corresponding ones of the dust extraction holes such that the teeth are not disposed in-line with the dust extraction holes;

wherein a quantity of the teeth is equal to a quantity of the dust extraction holes;

wherein the retaining knob further includes a handle that is movably coupled to the knob portion, the handle comprising a wire clip that is pivotally coupled to the knob portion; and wherein the exterior surface of the platen is disposed in a flat plane.

12. The tool of claim 2, wherein the exterior surface of the platen is disposed in a flat plane.

13. The tool of claim 5, wherein the exterior surface of the platen is disposed in a flat plane.

* * * * *